United States Patent [19]

Cutler

[11] Patent Number: 4,779,299

[45] Date of Patent: Oct. 25, 1988

[54] CLEANING SYSTEM

[76] Inventor: Barry L. Cutler, 7 Stanford Ct., East Windsor, N.J. 08520

[21] Appl. No.: 110,171

[22] Filed: Oct. 19, 1987

[51] Int. Cl.[4] ..... A47L 11/34; A47L 11/38

[52] U.S. Cl. ..... 15/97 R; 15/22 R; 15/231

[58] Field of Search ..... 15/22 R, 22 A, 22 C, 15/24, 29, 97 R, 98, 103, 231–233; 401/289, 290

[56] References Cited

U.S. PATENT DOCUMENTS

| | | | |
|---|---|---|---|
| 2,003,847 | 6/1935 | Woods | 15/98 X |
| 3,138,815 | 6/1964 | James, Jr. | 15/103 |
| 3,251,087 | 5/1966 | Platt, Jr. | 15/98 |
| 4,380,092 | 4/1983 | Brothers | 15/97 R X |

FOREIGN PATENT DOCUMENTS

| | | | |
|---|---|---|---|
| 1523413 | 3/1968 | France | 15/103 |

OTHER PUBLICATIONS

"Cost-Effective Carpet Maintenance for Airport Terminals", Sales Catalogue, The Von Schrader Co, date unknown.

"New System Provides Better Cleaning, Faster, More Effective Carpet Care", Cleaning Management, date unknown.

*Primary Examiner*—Edward L. Roberts

*Attorney, Agent, or Firm*—Woodcock Washburn Kurtz Mackiewicz & Norris

[57] ABSTRACT

A cleaning system includes a dolly having a base mounted on wheels and a handle at one end of the base. A tank for cleaning material and a pump are mounted on the base with the pump connected to the tank to deliver cleaning material from the tank. A box is also mounted on the base and is divided into compartments for receiving containers or cleaning material and cleaning pads. A cleaning head includes a housing having a handle. The cleaning head is small enough to be held in the hand of an operator. A plate extends across the bottom of the housing and is mounted on a vibrator mounted in the housing. The plate is adapted to hold a cleaning pad which extends across the bottom of the plate. A spray nozzle is mounted on the side of the housing and an elongated flexible tube extends from the nozzle to connect the nozzle to the pump. A switch button is on the handle of the cleaning head and is connected to the pump to selectively operate the pump and deliver cleaning material from the tank to the nozzle.

11 Claims, 2 Drawing Sheets

CLEANING SYSTEM

FIELD OF THE INVENTION

The present invention relates to a cleaning system, and, more particularly, to a dry cleaning system for fabric or carpet covered walls, furniture, stairs and risers, cove base or the like.

BACKGROUND OF THE INVENTION

Various systems have been developed and are on the market for cleaning, either wet or dry, carpeting or rugs on a floor. These system generally include a machine which can be moved over the floor carpeting and which applies and removes the cleaning material. However, there has been a recent trend to applying fabric or carpeting on wall or room divider panels. The machines which have been used for cleaning floor coverings are generally too large and cumbersome to be used on walls. Also, the fabrics used as wall coverings are often too delicate to be cleaned by the same equipment used for floors. Therefore, it would be desirable to have a cleaning system for fabric or carpet covered walls which can be easily used by the operator and which will provide good cleaning action without damaging the covering, even for relatively delicate fabrics.

SUMMARY OF THE INVENTION

A cleaning system including a cleaning head having a housing, a handle on the housing allowing the cleaning head to be held in the hand of an operator, a plate supported on the housing and adapted to support a cleaning pad, means in the housing for vibrating said plate, and a spray nozzle mounted on the housing. The spray nozzle is connected by an elongated flexible tube to a tank which can contain a cleaning material. The flexible tube allows the cleaner to be carried about separate from the tank. Means is provided for selectively providing cleaning material from the tank to the spray nozzle which applies the cleaning material to the fabric or carpet being cleaned.

DETAILED DESCRIPTION OF PREFERRED EMBODIMENT

Figure 2:
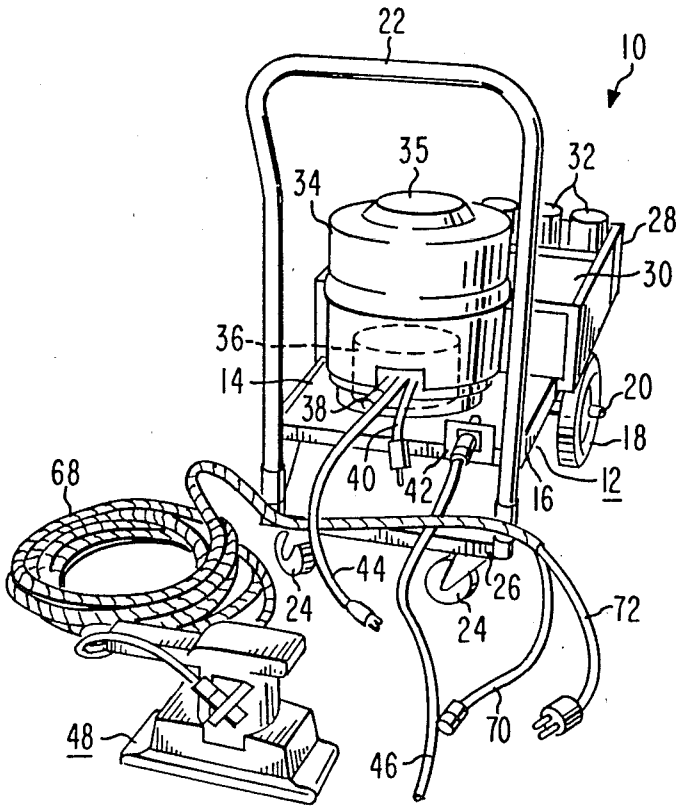
FIG. 2 is a perspective view of the cleaning system from the back.
Figure 1:
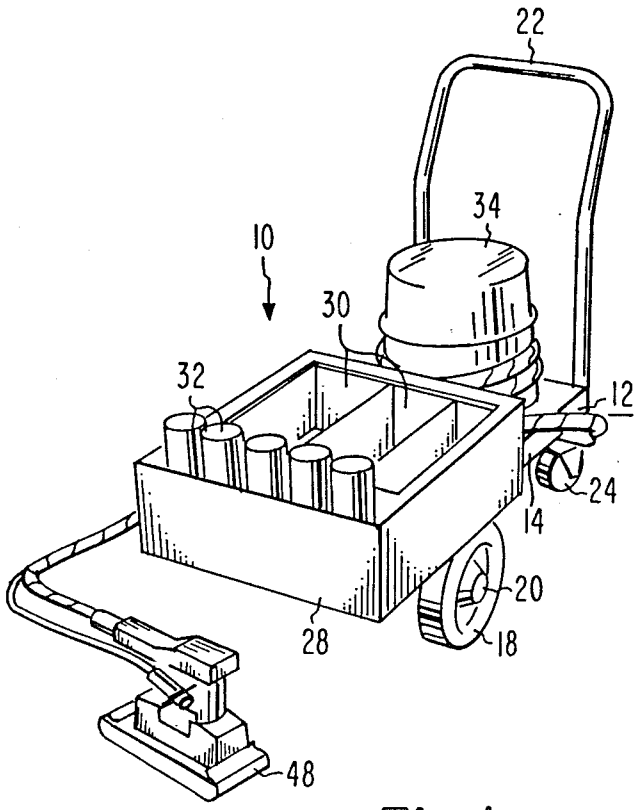
FIG. 1 is a perspective view of the cleaning system of the present invention from the front.

Referring initially to FIGS. 1 and 2, the cleaning system of the present invention is generally designated as 10. The cleaning system 10 includes a dolly 12 having a flat base 14 supported in a frame 16. A pair of wheels 18 are mounted on a shaft 20 extending acros the bottom of and secured to the frame 16 adjacent the front end thereof. An upright U-shaped handle 22 is secured to the back end of the frame 16. A pair of swiveled wheels 24 are mounted on a bar 26 extending across and secured to the bottom ends of the handle 22. Thus, the dolly 12 is movable on the wheels 18 and 24 and can be pushed about by the handle 22.

A box 28 is mounted on the base 14 at its front end. The box 28 is divided into compartments 30 which can hold cans or other containers 32 of cleaning material and cleaning pads. A tank 34 is mounted on the base 14 at its back end. The tank 34 is adapted to contain the cleaning material and has a cap 35 which can be removed to allow the tank 34 to be filled with the cleaning material. Under the cap 35 is a large replaceable filter for removing large particles of sand, grit, fibers, hair, lint and the like from the cleaning material. This filter can be removed, cleaned and replaced in the tank 34. The tank 34 has a recess in its bottom surface which fits over a pump 36 mounted on the base 14. The inlet port of the pump 36 is connected to the interior of the tank 34. Between the inlet port of the pump 36 and the tank 34 is a second microfilter for removing fine particles from the cleaning material. This second filter is located outside the tank so that it can be easily removed when it becomes filled. The two filters in the system remove contaminants and avoid breakdown of the system. The outlet port of the pump 36 has a tube 38 connected thereto and extending from the pump 36 to the back of the dolly 14. The motor of the pump 36 has a power line 40 extending therefrom which is adapted to be plugged into an electrical receptacle 42 on the back of the frame 16. The pump 36 also includes an electrically operated switch for turning the pump off and on and the switch has a cable 44 extending from the pump 36. A power cable 46 is provided which plugs into the receptacle and to a source of electrical current so as to provide power to the pump motor. The power cable 46 is long so that when the cable 46 is plugged into an outlet receptacle the dolly 12 can be moved around to allow cleaning of a large area of a room.

Figure 3:
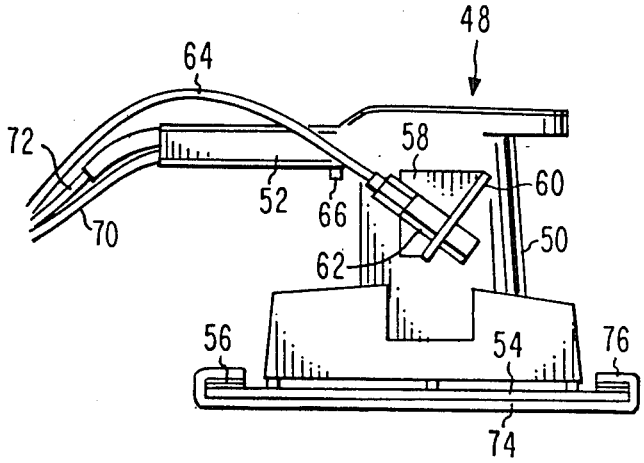
FIG. 3 is a side view of the cleaning head of the cleaning system.
Figure 4:
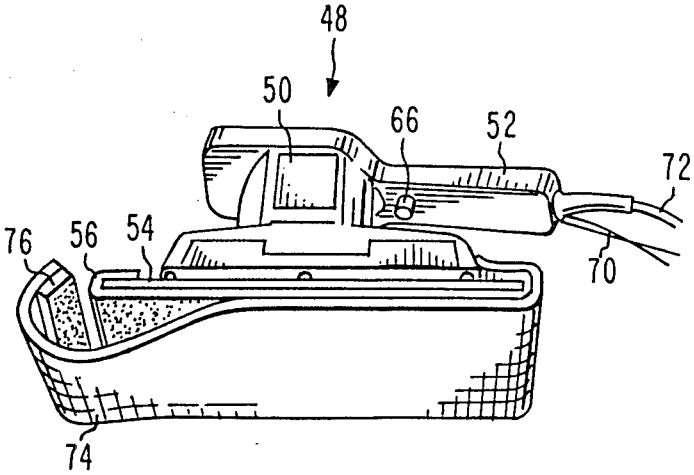
FIG. 4 is a perspective view of the cleaning head showing the manner of attaching a cleaning pad.

The cleaning system 10 includes a cleaning head 48 which is small enough to be carried in the hand of an operator. As shown in FIGS. 3 and 4, the cleaning head 48 includes a housing 50 having a handle 52 at its top which can be grasped by the hand of the operator. Along the bottom of the housing 50 is a rectangular plate 54 which projects beyond the ends of the housing 50. The plate 54 is mounted on a vibrator, not shown, mounted within the housing 50. The vibrator is of the type which will vibrate the plate 54 in a rotary motion, and, preferably one which can selectively vibrate the plate 54 in either a rotary motion or a linear motion. A sheet 56 of a Velcro material extends across and is secured to the bottom surface of the plate 54 and extends over the ends of the plate 54 to the top surface of the portion of the plate 54 which projects beyond the housing 50. The Velcro serves to hold a cleaning pad on the plate 54. However, instead of Velcro, other means, such as retaining clips However, instead of Velcro, other means, such as retaining clips at each end of the plate 54, may be used to hold a pad to the plate 54.

An L-shaped bracket 58 is mounted on the side of the housing 50 with one arm 60 of the bracket 58 extending outwardly from the housing 50. The surface of the arm 60 is angled toward the bottom of the housing 50. A spray nozzle 62 extends through and is mounted on the bracket arm 58 with the front end of the nozzle 62 facing toward the bottom of the housing 50. An elongated, flexible tube 64 extends from the back end of the nozzle 62. The operating button 66 of a switch projects from the bottom surface of the handle 52. The switch button 66 is for operating the switch of the pump 36. An elongated, flexible cable 68 extends from the end of the handle 52. The cable 68 is formed of the tube 64 from the nozzle 62, a power line 70 from the switch button 66, and a power line 72 from the vibrator in the housing 50. The housing 50 also has a switch, not shown, for operating the vibrator.

In the operation of the cleaning system 10, the spray nozzle tube 64 is connected to the tube 38 extending from the outlet port of the pump 36. The switch button power line 70 is connected to the pump switch cable 44 and the vibrator power line 72 is plugged into the receptacle 42. The pump power line 40 is also plugged into the receptacle 42, and the power cable 46 is connected between the receptacle 42 and a source of electrical current. The tank 34 is filled with a cleaning material, and a cleaning pad 74 is mounted o the bottom surface of the plate 54 of the cleaning head 48. The cleaning pad 74 is of a toweling material having end portions 76 which are woven so as to adhere to the Velcro material. Thus, the end portions 76 of the cleaning pad 74 are wrapped around the ends of the plate 54 and adhered to the Velcro material sheet 56 which is on the top surface of the ends of the plate 54 or retaining clips or other securing means at the ends of the plate 54.

The operator then lifts the cleaning head 48 by the handle 52 and holds it with the pad 74 facing the wall to be cleaned. The operator than presses the switch button 66 which operates the pump 36 causing some of the cleaning material from the tank 34 to be fed to the nozzle 62 which sprays the cleaning material onto the wall. The operator turns on the vibrator and places the cleaning pad 74 against the wall. The vibrating motion of the cleaning pad 74 against the fabric on the wall scrubs the cleaning material on the fabric to clean the fabric. The cleaning pad 74 then absorbs the dirty cleaning material. This cleaning operation is continued across the entire area of the wall. When one side of a cleaning pad 74 becomes dirty, it can be easily stripped from the plate 54, turned over and replaced on the plate 54 with a clean surface facing outwardly. When both sides of the pad 74 become dirty, the pad 74 can be removed and replaced with a clean pad 74. A supply of cleaning pads 74 is maintained in the box 28 on the dolly 12. Although a rotary vibrating motion is generally preferred, there are some fabrics which have a weave which makes a linear motion more desirable. Also, in cleaning furniture, a linear motion may be more desirable for corners of the furniture and pillows. The cans 32 in the box 28 may contain cleaning material for the tank 34, or special cleaning material for spots or stains.

Thus, there is provided by the present invention a cleaning system 10 for cleaning fabric or carpet covered walls or furniture which includes a cleaning head having vibrating motion to thoroughly clean the wall without damaging the fabric or carpet. The cleaning head 48 is light in weight and has a handle that allows it to be easily carried in the hand of an operator with minimum operator fatigue. There is a long cable between the cleaning head 48 and the dolly 12 so that the cleaning head can be easily moved along an entire wall. Also, the entire cleaning system 10 is mounted on a dolly 12 which allows it to be easily moved from place to place. In addition, all of the parts of the system are carried on the dolly 12 so that they are easily available when needed. The cleaning pads 74 can be easily placed on and removed from the cleaning head.

I claim

1. A cleaning system comprising:

a cleaning head having a housing, a handle on the housing allowing the cleaning head to be held in the hand of an operator, a plate supported on the housing and adapted to support a cleaning pad, means within the housing for vibrating said plate, and a spray nozzle mounted on the housing;

a tank for containing a cleaning material;

an elongated flexible tube connecting the tank to the spray nozzle on the housing but allowing the cleaning head to be moved separately from the tank; and means for selectively provided cleaning material from the tank to the spray nozzle.

2. A cleaning system in accordance with claim 1 in which the plate had means thereon for holding a cleaning pad thereto.

3. A cleaning system in accordance with claim 2 in which the means for holding a cleaning pad to the plate comprises a sheet of Velcro material or retaining clips.

4. A cleaning system in accordance with claim 3 in which the plate is rectangular and projects beyond the ends of the housing, and the Velcro material extends across the bottom of the plate, over the ends and onto the top surface of the end portions of the plate which project beyond the housing.

5. A cleaning system in accordance with claim 2 in which the means for providing cleaning material from the tank to the spray nozzle includes a pump connected between the tank and the flexible tube.

6. A cleaning system in accordance with claim 5 including a switch button on the handle of the cleaning head and means connecting the switch button to the pump for selectively operating the pump.

7. A cleaning system in accordance with claim 6 in which the cleaning head has an elongated flexible cable extending therefrom, said cable comprising the flexible tube from the spray nozzle, a power line from the vibrating means in the housing and a power line from the switch button.

8. A cleaning system in accordance with claim 7 including a L-shaped bracket mounted on said cleaning head housing having an arm projecting from the side of the housing, and the spray nozzle extends through and is mounted on said arm.

9. A cleaning system in accordance with claim 8 including a dolly having a base mounted on wheels and a handle at one end of the base, said tank and pump being mounted on the base of said dolly.

10. A cleaning system in accordance with claim 9 in which the pump is mounted on the base of the dolly and the tank has a recess in its bottom which fits over the pump.

11. A cleaning system in accordance with claim 10 including a box mounted on the base of the dolly, said box being divided into compartments for receiving containers of cleaning material and cleaning pads.

* * * * *